United States Patent [19]

Cheng

[11] Patent Number: 5,044,173

[45] Date of Patent: Sep. 3, 1991

[54] COLD-PRESERVING CUP

[76] Inventor: Chuang S. Cheng, No. 199, Ta Chu Rd., Ta Chu Village, Lu Chu Hsiang, Tao Yuan Hsien, Taiwan

[21] Appl. No.: 563,719

[22] Filed: Aug. 7, 1990

[51] Int. Cl.[5] ..... F25D 3/08

[52] U.S. Cl. ..... 62/372; 62/457.3

[58] Field of Search ..... 62/372, 457.3, 529; 126/263, 400

[56] References Cited

U.S. PATENT DOCUMENTS

| | | | |
|---|---|---|---|
| 2,187,558 | 1/1940 | Kushima | 62/457.3 X |
| 2,288,044 | 6/1942 | Stemme | 62/457.3 X |
| 2,526,165 | 10/1950 | Smith | 62/457.3 |
| 2,876,634 | 3/1959 | Zimmerman et al. | 62/457.3 |
| 3,059,452 | 10/1962 | Griffin | 62/529 X |
| 3,662,741 | 5/1972 | Licher | 126/263 |
| 4,765,393 | 8/1988 | Baxter | 61/372 X |
| 4,981,022 | 1/1991 | Snyder | 62/457.3 |

*Primary Examiner*—William E. Tapolcai
*Attorney, Agent, or Firm*—Bacon & Thomas

[57] ABSTRACT

A cold-preserving cup mounting comprising a first mid-hollow cup and a second hollow stick, said hollow stick being itself firmly screwed to a mid-hollow cup from the bottom hole. The thus established mounting permits anyone to enjoy chilly drinks provided the hollow stick is first refrigerated before being screwed to the mid-hollow cup.

2 Claims, 1 Drawing Sheet

COLD-PRESERVING CUP

BACKGROUND AND SUMMARY OF THE INVENTION

The present invention relates to a cold-preserving cup mounting comprising a first, mid-hollow cup wide at the top narrowing at the bottom in the inside. The invention provides that screw-threads and nontoxic silicone cushionings are mounted at the bottom stand thus preventing any water leakage. Furthermore, the upper part of the hollow stick is mounted with a spiral cover which can be screwed to the hollow cup at any time. The invention also provides that the length of the hollow stick does not, in any case, exceed the height of the mid-hollow cup, thus ensuring practical use of the cup.

A practical invention of this type is suitable for individual use and is very easily assembled. This invention is not yet on the market and compared to any similar invention of this kind, the present invention possesses a more simplified, effective structure which has been corrected and advanced, especially for what concerns individual use of the cup. The whole embodiment is extremely practical and reliable and can be fully enjoyed when the hollow stick is screwed up to the mid-hollow cup.

A cold-preserving cup mounting of this type is already known from Taiwan application No. 76209939. This kind of mounting comprises a cup stand and a body element fixed into one another leaving an empty space in-between with an opening at the bottom of the cup to allow filling of a cooler. The usefulness of this mounting is restricted by the fact that the cold-preserving cup has a large volume and has to kept in the refrigerator or freezer even when not in use. In other words, such a mounting necessitates such a large volume since the object of the invention is to allow a certain amount of beverage to be consumed little by little. Due to the large volume, it is impractical thereby to conserve in the refrigerator or freezer and furthermore, has to depend on the cooler. Therefore, so as to match with one object of the invention, the known mounting is not exactly adequate.

The known cold-preserving cup compared above is restricted by many disadvantages and relatively causes much difficulties for cleaning after use. According to the design, temperature is conducted from the bottom such that the present invention of the cold-preserving cup mounting at the middle is highly advantageous and simple in a unique manner.

After comparing the known cold-preserving cup mounting to the present cold-preserving mounting, we can clearly deduce that the present invention does not, in any case, dilute beverages i.e. does not require the addition of ice cubes, is safely mounted in a simplified way and allows easy cleaning among other advantages.

In accordance with the invention, the object is attained by simply inserting the hollow stick into the mid-hollow cup, so that it facilitates individual use of the cup for cool drinks and complete satisfaction of thirst.

In a very advantageous embodiment, the invention provides that only the hollow stick needs to be refrigerated or frozen thus being highly practical since its volume is smaller in relation to the whole cup.

In a further advantageous embodiment, the invention provides that the hollow stick is easily cleaned up after use. After being screwed out of the mid-hollow cup and cleaned up, the said hollow stick can be safely put into the refrigerator or freezer for use once more.

The hollow stick of the present invention is generally filled with a liquid capable of keeping a certain temperature for a certain moment and is positively sealed up. The material used for the hollow stick is of a resisting nature capable of conducting temperature.

BRIEF DESCRIPTION OF THE DRAWINGS

An embodiment of the invention shall now be described by way of example with reference to the accompanying drawings, where in.

DETAILED DESCRIPTION OF THE PREFERRED EMBODIMENT

Figure 1:
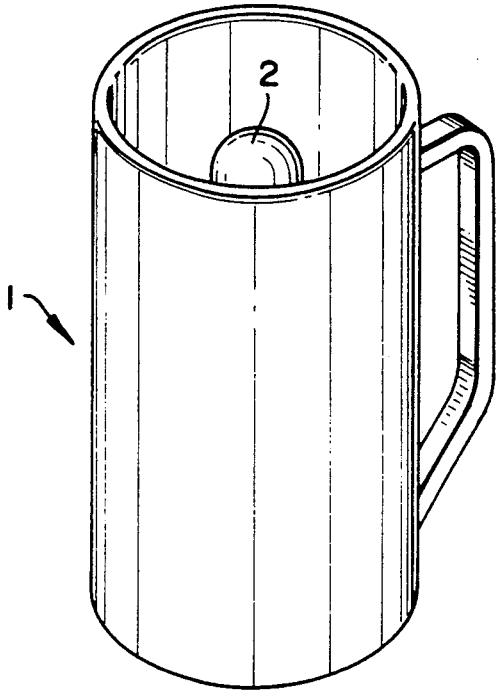
FIG. 1 is a perspective view of the present invention.

The present invention of the cold-preserving cup as shown in FIG. 1 consists of a hollow stick 2 mounted in mid-hollow cup 1.

Figure 2:
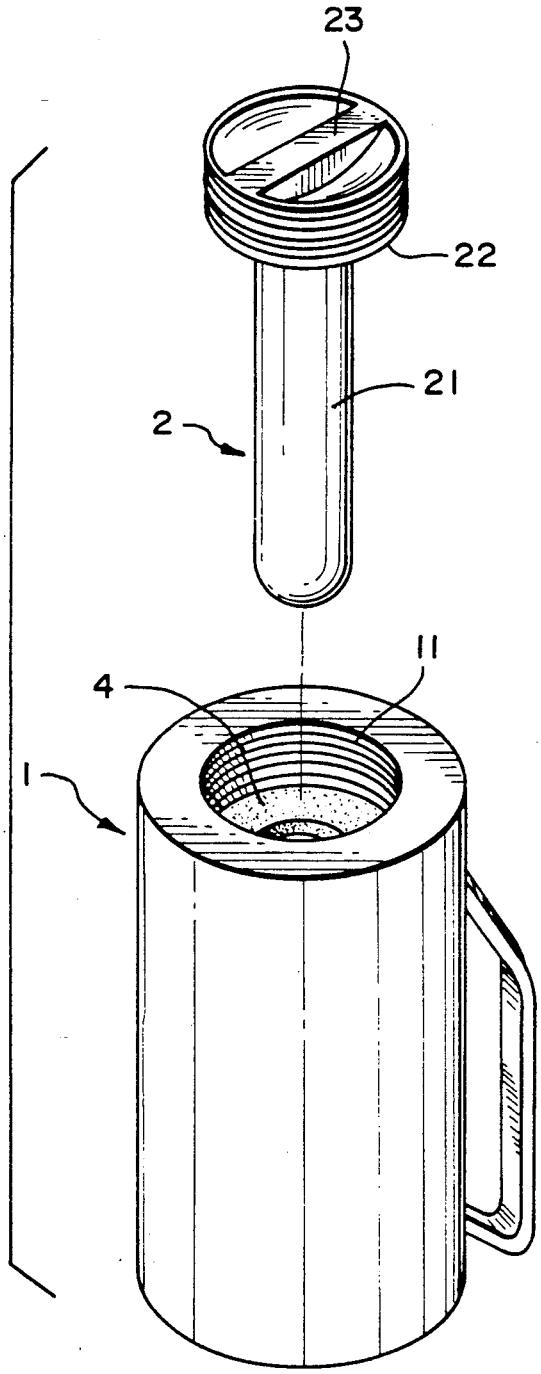
FIG. 2 is an exploded perspective view showing the hollow stick removed from the mid-hollow cup.

In the present invention of a hollow stick 2 as shown in FIG. 2, nontoxic silicone cushionings 4 are disposed at the stand of the mid-hollow cup and are related to the hollow stick 2 and spiral cover 23 such that water leakage is avoided when the hollow stick is screwed to the mid-hollow cup. The inner ring 11 of the mid-hollow cup as well as the ouring ring 22 of the hollow stick cover 23 are mounted in a spiral manner to enable screwing of the hollow stick 2 into the mid-hollow cup 1.

Figure 3:
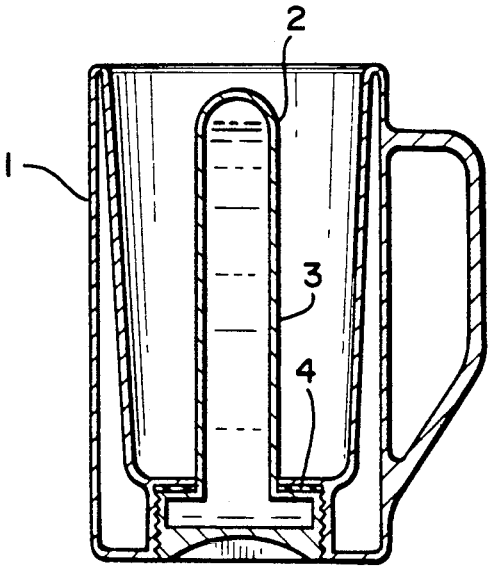
FIG. 3 is a sectional view of the present invention.

In the present invention as shown in FIG. 3, appropriate measures of a liquid capable of keeping a certain temperature for a certain moment is filled into the body 3 of the hollow stick 2. The said hollow stick 2 is furthermore completely sealed up and after being mounted to the mid-hollow cup, any beverage poured into the cup can be immediately enjoyed with a nice and cool taste. After use, the hollow stick can be screwed out of the mid-hollow cup for cleaning and can be easily prepared for the next use.

I claim:

1. A cup for containing and cooling a beverage comprising:

a) a hollow body having an open top, an interior wall and a bottom wall;

b) an aperture formed in the bottom wall;

c) a hollow stick including an upper end and a base, the hollow stick being receivable through the aperture and disposable within the body to define an annular space between the hollow stick and the interior wall of the body for containing a beverage;

d) cooperating threaded portions formed in the bottom wall around the aperture and the base of the hollow stick to permit a detachable and liquidtight threaded engagement between the base of the hollow stick and the bottom wall of the body; and e) means contained within the hollow stick for maintaining a refrigerated temperature to cool the beverage contained in the annular space.

2. The cup of claim 1 wherein:

a) the threaded portion in the bottom wall of the body includes a threaded recess provided with a sealing means; and b) the base of the hollow stick being fully disposable within the threaded recess when the base is threadedly engaged therein to permit the bottom wall of the cup to be supported in a position for containing the beverage in the annular space.

* * * * *